US007931140B2

(12) United States Patent
Heidenreiter

(10) Patent No.: US 7,931,140 B2
(45) Date of Patent: Apr. 26, 2011

(54) COSMETIC CONTAINER WITH INTEGRATED MIXING INSERT

(75) Inventor: Thomas Heidenreiter, Kalchreuth (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 808 days.

(21) Appl. No.: 11/500,020

(22) Filed: Aug. 7, 2006

(65) Prior Publication Data

US 2007/0036607 A1 Feb. 15, 2007

(30) Foreign Application Priority Data

Aug. 9, 2005 (DE) ..... 20 2005 012 516 U

(51) Int. Cl.
*B65D 25/08* (2006.01)
*A45D 40/00* (2006.01)

(52) U.S. Cl. ..... 206/219; 401/4; 401/129

(58) Field of Classification Search ..... 206/219, 206/220, 385, 823; 401/4, 5, 129, 127, 128, 401/122; 132/218, 73.5; 366/130, 238, 314, 366/247, 318, 330.1
See application file for complete search history.

(56) References Cited

U.S. PATENT DOCUMENTS

| | | | | |
|---|---|---|---|---|
| 2,631,826 | A | 3/1953 | Wolf | |
| 2,793,012 | A | 5/1957 | Wolf | |
| 2,904,808 | A | 9/1959 | Massman | |
| 3,085,281 | A * | 4/1963 | Massman | 401/4 |
| 3,115,664 | A * | 12/1963 | Del Ponte Otello | 401/4 |
| 3,209,387 | A | 10/1965 | Lukesch | |
| 3,311,941 | A | 4/1967 | Buchwalter et al. | |
| 3,336,624 | A | 8/1967 | Schefer et al. | |
| 3,456,923 | A | 7/1969 | Zeuzem | |
| 4,290,706 | A * | 9/1981 | Wandl | 401/4 |
| 4,332,494 | A * | 6/1982 | Kingsford | 401/5 |
| 4,984,918 | A | 1/1991 | Iizuka et al. | |
| 5,074,693 | A * | 12/1991 | Iizuka et al. | 401/4 |
| 5,172,992 | A * | 12/1992 | Ackermann | 401/4 |
| 5,192,153 | A * | 3/1993 | Gueret | 401/4 |
| 6,033,142 | A | 3/2000 | Gueret | |
| 6,568,405 | B2 * | 5/2003 | Masuyama | 132/218 |

FOREIGN PATENT DOCUMENTS

| | | |
|---|---|---|
| DE | 91 06 771.5 | 1/1992 |
| DE | 691 02 930 | 3/1995 |
| DE | 692 03 222 | 11/1995 |
| DE | 44 03 689 | 8/1996 |
| EP | 1 177 741 | 2/2002 |
| FR | 1.517.002 | 3/1968 |
| GB | 1 393 823 | 5/1975 |

* cited by examiner

*Primary Examiner* — J. Gregory Pickett
*Assistant Examiner* — Ernesto A Grano
(74) *Attorney, Agent, or Firm* — Bachman & LaPointe, P.C.

(57) ABSTRACT

A cosmetic container with integrated mixing insert which serve for mixing up or thoroughly mixing an application substance contained in the cosmetic container and/or for preventing or delaying the separation of the contained application substance into the phases thereof. In that respect the mixing insert is of a configuration that an application substance is mixed up in the cosmetic container shortly prior to application by a respective mixing operation in order to guarantee homogeneity of the application substance.

7 Claims, 8 Drawing Sheets

COSMETIC CONTAINER WITH INTEGRATED MIXING INSERT

BACKGROUND OF THE INVENTION

The present invention concerns a cosmetic container with an integrated mixing insert.

In conventional cosmetic containers with an applicator, the applicator is loaded with a substance to be applied, that is to say the application substance, when the container is closed. For that purpose the applicator is usually of such a configuration that it can be loaded with the application substance in a quantitatively controlled fashion. That can be a special material, for example a sponge-like material which becomes saturated with the application substance or bears it at its surface in order then to be able to apply it to an application surface in a quantitatively controlled and targeted fashion. Frequently the applicator is in one piece with the lid or closure of the cosmetic container.

The application substance can be for example cosmetics. They can be for example creams, ointments or materials which are intended to be applied to the skin of a female or male user. Such cosmetics comprise synthetic but in particular vegetable or animal base substances and serve either to emphasise individual parts of the body, generally on the face (for example lipstick or eyeshadow) or for covering or concealing for example scars or pock marks. In general terms cosmetics serve to improve appearance or for medical purposes. A cosmetic can also be a fluid such as for example eyelash mascara which can be applied by the applicator being passed over the eyelashes.

Over the entire period of use, that is to say as long as there is still application substance in the container, the applicator is to be uniformly loaded thereby when the cosmetic container is or becomes closed. That presupposes a stable application substance. In other words, when the applicator is loaded the substance should not be in a condition of being separated into its individual phases, that is to say ideally the application substance should be homogenous. That is not the case however with many compositions of application substances, which are of interest, and as a result of that it can happen that the applicator is wetted with only one phase to a greater or lesser degree. The consequence of this is a makeup result with properties which do not remain the same.

In order to counteract the above-depicted problem, the production of application substances necessitates special material settings or stabilisers which generally do not correspond to the composition for an optimum makeup result or makeup effect. The result of this can be that application substances have to be discarded when, for the above-indicated reason, it is not possible to ensure uniform application over the period of use.

Accordingly an object of the present invention is to provide a cosmetic container for application substances, with which the above-indicated disadvantages can be overcome.

SUMMARY OF THE INVENTION

That object is attained by a cosmetic container comprising a container body having a longitudinal axis (A), a container opening with a removable closure, on which there is provided an applicator stem having an applicator arranged at an end in opposite relationship to the closure, and a hollow space for receiving the applicator stem, the applicator and an application substance, wherein provided in the hollow space is a radial mixing insert which is stationary with respect to the container body and which is rotatable about longitudinal axis (A) and which has an open end fitted into the container opening and coincident with the container opening and which can be releasably connected to the closure and/or the applicator stem.

Basically the cosmetic container of the invention, hereinafter for brevity referred to also only as the container, has a container opening and a removable closure. Provided on the closure is an applicator stem on which there is an applicator disposed at an end in opposite relationship to the closure. The cosmetic container also has a hollow space for receiving the applicator stem, the applicator and the application substance, as well as a respective mixing insert according to the invention which is designed in accordance with an aspect of the invention.

In appropriate use of the container the applicator with the applicator stem is introduced into the hollow space through the container opening when the cosmetic container is closed by means of the removable closure. In that closed condition, also referred to as "parking" the applicator, the applicator also becomes loaded with application substance.

As a central element, a mixing insert according to the invention for mixing up or thoroughly mixing the applicator fluid in the hollow space is integrated into each of the design configurations described hereinafter of the cosmetic container according to the invention. Preferably the application substance is mixed up or thoroughly mixed in accordance with the invention just prior to the respective use, that is to say ideally when opening the cosmetic container or in combination with opening of the cosmetic container.

The mixing insert can be introduced from the bottom end in production of the container, if that is necessary due to the configuration involved. The container is then sealingly closed by inserting a bottom portion or container bottom, for example by pushing it into place, screwing it into place, welding into place or the like.

As already mentioned above, actuation of the mixing insert is preferably effected in conjunction with opening or also closing of the container, that is to say together with removal of the closure and withdrawal of the applicator or, in some embodiments, also in addition to fitting the closure in position and parking of the applicator, which is linked thereto. For that purpose the mixing insert can be releasably connected to the applicator stem or the closure upon opening or closing of the container. The mixing insert is substantially guided in the hollow space and thoroughly mixes the applicator fluid while the applicator is being removed and/or introduced. It is however also possible to provide for actuation of the mixing insert independently of the operation of closing or opening the container, that is to say when the container is in a closed condition, by suitable movement, for example by a rotary and/or axial movement of the closure.

Accordingly the cosmetic container designed in accordance with the invention provides that an application substance which has split up into phases can be thoroughly mixed or mixed up immediately prior to application. In that way the applicator element is always loaded with a homogenously mixed application substance. It is also particularly advantageous that it is possible with the containers of the present invention to devise application substances, in particular application fluids, in which there is no need to consider the settlement characteristics of the individual phases relative to each other.

In a first aspect of the invention provided in the hollow space in the cosmetic container is a mixing insert which is stationary with respect to the container and rotatable about the longitudinal axis of the container, in the form of a radial mixing insert, that is to say the mixing effect is designed in particular for a movement of the application substance in a radial direction. The radial mixing insert has an open end which is fitted into the container opening and which coincides with the container opening and can be releasably connected to the closure and/or the applicator stem. In that respect the closure and/or the applicator stem in the connected condition can co-operate in such a way that a rotary movement of the closure about the longitudinal axis of the container in at least one direction of rotation causes a corresponding rotary movement of the radial mixing insert.

In a first embodiment of the first aspect of the invention the hollow space and an outside surface of the radial mixing insert, that is to say the surface which is towards the container inside wall of the hollow space, is of a rotationally symmetrical configuration with respect to the longitudinal axis of the container. In that case at least a part of the outside surface of the radial mixing insert bears against the inside wall of the container. The open end of the radial mixing insert, which is opposite to the container opening, is closed by the container bottom. In a first embodiment the radial mixing insert is in the form of a half-shell portion, that is to say it substantially comprises a 180° segment.

Provided at the inside surface of the radial mixing insert, which now forms so-to-speak the container inside wall of the hollow space for the application substance, is at least one mixing element for moving the application substance in the radial direction. In principle the at least one mixing element can be of any desired shape which upon rotation of the radial mixing insert has a mixing effect on the application substance. By way of example the mixing element can be in the form of a straight arm which extends along the inside surface of the radial mixing insert. Preferably such an arm is of such a height that it is in contact with the applicator stem when the applicator is in the parked condition.

Particularly good mixing results are achieved with a mixing element in the form of an arm extending in a helical configuration along the inside surface of the radial mixing insert. Here the mixing effect can be still further improved by at least two helical arms being provided as mixing elements, with mutually oppositely extending helical directions. In the last case the application substance is moved simultaneously in both longitudinal directions of the container and thus the preferred movement of the application substance in the radial direction relative to the longitudinal axis of the container is achieved.

In a second embodiment of the first aspect of the invention the space in the cosmetic container is again of a rotationally symmetrical configuration with respect to the longitudinal axis of the container. In contrast the radial mixing insert is of a cross-section which is asymmetrical with respect to the longitudinal axis of the container, being for example of an oval shape, and the radial mixing insert has a mixing edge which bears against the inside wall of the container. It should be noted that the longitudinal axis of the container does not have to extend through the centroid of the cross-sectional area of the radial mixing insert, but only an edge of the radial mixing insert, which forms the mixing edge, is arranged in such a way that it sweeps along the inside wall of the container, similarly to a spatula, upon rotation of the radial mixing insert about the axis of the container.

In addition, a mixing helix with a helix axis which is substantially parallel to the longitudinal axis of the container can also be arranged on the radial mixing insert opposite the mixing edge, the mixing helix being moved upon rotation of the radial mixing insert through the application substance and providing for an additional mixing effect for the application substance.

By virtue of the non-rotationally symmetrical shape of the radial mixing insert the application substance is forced into the region between the radial mixing insert and the inside wall of the container and in that situation thoroughly mixed by virtue of the co-operation of the mixing edge with the inside wall of the container. It has proven to be particularly advantageous if the radial mixing insert is additionally provided in the region of the mixing edge with a plurality of mixing apertures, through which the application substance is conveyed back into the inner region of the radial mixing insert in the rotational movement of the radial mixing insert.

In a third embodiment of the first aspect of the invention the hollow space in the cosmetic container is of a rotationally symmetrical configuration with respect to the longitudinal axis of the container and the radial mixing insert comprises a central tube which is so arranged that it receives the parked applicator. Disposed on the central tube are a plurality of mixing element carrier surfaces which extend from the central tube in the direction of the inside wall of the container. In that arrangement the hollow space in the container is subdivided into a plurality of mixing chambers by the mixing element carrier surfaces. Provided in the central tube of the radial mixing insert, for each mixing chamber, is at least one mixing aperture, past which the applicator passes on being withdrawn from the container. The fact that the space in the container is sub-divided into a plurality of partial chambers in this embodiment additionally provides that the application substance can separate out of its mixture only in those partial chambers.

Preferably at least one respective mixing element is provided on the mixing element carrier surfaces for increasing the mixing effect, the mixing element being so arranged on the mixing element carrier surface that it projects into the respective mixing chamber. Particularly preferably such a mixing element is in the form of a mixing vane. In addition the mixing element carrier surfaces can each have at least one mixing aperture in adjacent relationship with the inside wall of the container.

In a second aspect of the invention provided in the hollow space in the cosmetic container is a tubular mixing insert which is stationary with respect to the container and which is rotatable about the longitudinal axis of the container and which has an open end which fits into the container opening and coincides with the container opening. When the container is closed the mixing insert accommodates the applicator stem together with the applicator and can be releasably connected to the closure and/or the applicator stem in such a way that a rotary movement of the closure about the longitudinal axis of the container causes a corresponding rotary movement of the mixing insert. In addition, arranged in the region between the mixing insert and the inside wall of the container is a mixing plate having a central hole with a female screwthread which is in engagement with a corresponding male screwthread on the mixing insert. In principle that arrangement can also be reversed, that is to say the corresponding screwthreads for converting the rotary movement of the unit consisting of the mixing insert and the mixing plate into a stroke movement of the mixing plate in the direction of the longitudinal axis of the container are then to be correspondingly provided on the inside wall of the container and on the faces of the mixing plate which are in contact with the inside wall of the container. In that case the mixing plate is non-rotatably connected to the radial mixing insert and is correspondingly entrained upon rotation of the radial mixing insert.

In that arrangement a rotary movement of the mixing insert results in a corresponding stroke movement of the mixing plate, in order to ensure that the mixing plate does not rotate with respect to the hollow space in the container, the shape of the outside edge of the mixing plate, which is directed towards the inside wall of the container, can be of a non-rotationally symmetrical configuration, that is to say non-round, being for example rectangular, oval or the like. If the contour of the contact line between the mixing plate and the inside surface of the hollow space is rotationally symmetrical, one or more guide means, for example a corresponding combination of a groove and a corresponding leg, can additionally be provided between the mixing insert and the mixing plate in order to exclude rotation of the mixing plate with respect to the mixing insert.

It is particularly advantageous if the closure is a screw closure. The pitch of the screwthread provided on the mixing insert and at the central hole of the mixing plate can then be matched to the pitch of the screwthread of the screw closure in such a way that a rotary movement of the closure when opening or closing the container is converted into a longitudinal movement of the mixing plate with the desired stroke. In that respect a stroke movement over the entire internal height of the hollow space in the container is also conceivable.

The forgoing arrangement provides that the hollow space in the container is sub-divided by the mixing plate into two variable partial chambers. If the tubular mixing insert has at least one mixing aperture at least in a region adjacent to the container opening, then a rotary movement of the mixing insert, besides the intended stroke movement of the mixing plate which moves the application substance, also causes circulation of the application substance by way of the mixing aperture and the tubular mixing insert between the two chambers and thus affords the desired effect of mixing up the application substance. A change in the direction of rotation causes a corresponding change in the direction of circulation. It is also possible, instead of or in addition to the at least one mixing aperture in the tubular mixing insert, to provide in the mixing plate a plurality of mixing apertures or a multiplicity of small mixing apertures, through which the application substance is pressed when the mixing plate is moved in the longitudinal direction of the container, thereby also producing a thorough mixing action.

In a third aspect of the invention, provided in the hollow space in the container is a tubular mixing insert which has an open end which fits into the container opening and which coincides with the container opening and which is of such a configuration that the mixing insert can be reversibly displaced in the direction of the longitudinal axis of the container by a limited distance. Preferably for that purpose the mixing insert is supported resiliently by means of a spring means which are arranged between the mixing insert and the inside wall of the container, which has the container opening. It is also possible for the spring means to be arranged between the mixing insert and the container bottom. It will be appreciated that both alternatives can also be combined.

In principle any elastically deformable, that is to say compressible and resiliently returnable, means can be used as the spring means. Preferably a spring is used, comprising a suitable material, that is to say which does not chemically or corrosively react with the application substance. Depending on the respective arrangement of the spring, it is in the form of a tension or a compression spring. It is equally possible for the spring means used to be in the form of a resiliently compressible material. Preferably the mixing insert is moved by the predetermined distance in the direction of the container opening by the spring means when the container is opened, and thus provides for thorough mixing of the application substance. When the container is closed the mixing insert is restored to its starting position again by co-operation with the closure and/or the applicator stem and at the same time prestresses the spring means for the next mixing operation when the container is next opened.

To increase the application substance mixing effect according to the invention, arranged on the tubular mixing insert are mixing elements in the form of mixing plates which are perpendicular with respect to the longitudinal axis of the container and which are in mutually spaced relationship and which extend from the mixing insert in the direction of the inside wall of the container. Furthermore, at least one respective mixing aperture is arranged in the tubular mixing insert over the entire region which is in the hollow space in the container, between two adjacent mixing plates and in each mixing plate. The mixing plates can also each be provided with a respective plurality of mixing apertures which are distributed over the respective mixing plate. It is advantageous in that respect for the mixing apertures in the mixing plates to be provided in the proximity of the inside wall of the container and to be arranged in mutually displaced relationship on two respective mutually adjacent mixing plates. In that way the mixing arrangement comprising the mixing insert and the mixing plates forms a labyrinth system through which the application substance is urged upon movement of the arrangement by the defined mixing stroke.

In the third aspect of the invention, for actuation of the radial mixing insert, it is also possible for the radial mixing insert to be adapted to be connectable to the closure at the container opening in such a way that a movement of the closure in the direction of the longitudinal axis of the container can occur as a corresponding movement of the radial mixing insert even when the container is closed. Thorough mixing of the application substance is then possible, independently of opening of the container.

In a fourth aspect of the invention there is provided a tubular mixing insert which in the region of the open end which coincides with the container opening is of an inside diameter which substantially corresponds to the outside diameter of the applicator stem in a region adjacent to the closure. Furthermore the tubular mixing insert in the hollow space in the container has at least one mixing aperture at least in a region adjacent to the container opening. Preferably the open area of the mixing aperture in the mixing insert is substantially larger than the area of the gap formed by the lower end of the tubular mixing insert together with the container bottom.

The above-described dimensioning of the inside diameter of the tubular mixing insert and the outside diameter of the applicator stem provides that the applicator stem and the mixing insert, upon opening of the container, co-operate as a suction piston and can thus produce a reduced pressure in relation to the ambient atmosphere. In that way, upon opening of the container and withdrawal of the applicator from the container, which is linked to opening of the container, the suction effect produced causes application substance to be sucked upwardly into the tubular mixing insert through the open area of the gap formed by the lower end of the tubular mixing insert together with the container bottom, that substance then being returned into the chamber formed from the inside wall of the container and the mixing insert through the open area of the mixing aperture in the mixing insert. When the container is closed or also upon parking of the container, that application substance transport movement takes place in the reverse direction.

In this connection it has proven to be particularly advantageous to provide on the container a valve which is so designed that the increased pressure built up in the container with respect to the ambient atmosphere when closing the container due to the co-operation of the applicator stem with the mixing insert is avoided or limited. It is possible in that way to ensure that application substance does not unintentionally escape upon closure of the container and subsequent storage of the closed container, due to an internal pressure which is higher than the ambient atmosphere.

Preferably that valve is so designed that, upon opening of the container, due to the above-described suction piston principle, a suction effect can be built up in the tubular mixing insert, that is to say a reduced pressure in the container in relation to the atmosphere around the container. Basically the valve function can be implemented with any technical means suitable for that purpose. A valve can be particularly easily implemented for example by means of an annular seal on the applicator stem in the region of the closure, the annular seal being supported in a valve groove in which there is a vent opening. The valve is then formed by the annular seal which is supported displaceably in the valve groove, together with the vent opening. In that arrangement, with the position of the vent opening in the valve groove, it is possible to set the arrangement in such a way that the vent opening is closed by the annular seal upon opening of the container and the annular seal is displaced upon closure of the container, in such a way that the vent opening is opened.

In a first embodiment of a fifth aspect of the invention, provided in the hollow space in the cosmetic container is a tubular mixing insert which has an open end coincident with the container opening and which is of such a configuration that there is a capillary gap between the applicator stem and the mixing insert when the container is in a closed condition.

To increase the capillary action, that is to say the effective area of the capillary gap, the tubular mixing insert can be provided with arms extending in parallel relationship with the longitudinal axis of the container, on the inside which is towards the inserted applicator stem. In that arrangement those arms are of such a configuration that two respective adjacent arms jointly form a capillary chamber, thereby affording an increase in the effective area of the capillary gap which is between the end faces of the arms and the applicator stem. In that way the inside surface of the mixing insert has a lamellar structure, the arms corresponding to the lamellar plate portions. When the applicator is withdrawn from the cosmetic container the applicator element is taken past those capillary chambers and loaded with the applicator substance.

In addition application substance can be conveyed into the capillary gap between the applicator stem and the inside surface of the tubular mixing insert due to the capillary action upon withdrawal of the applicator from the container, thus affording the desired thorough mixing of the application substance. In addition, at least in a region in adjacent relationship with the container opening, the tubular mixing insert can have at least one mixing aperture, through which application substance which has been conveyed upwardly into the tubular mixing insert can flow back into the hollow space in the container. The tubular mixing insert can in turn also have a plurality of such mixing apertures over the entire region in the hollow space in the container.

In a second embodiment of the fifth aspect of the invention the conveying action of that arrangement can be additionally increased by virtue of the fact that the applicator stem, in accordance with the fourth aspect of the invention, is additionally in a portion adjacent to the closure, substantially of an outside diameter which corresponds to the inside diameter of the mixing insert in the region of the container opening. In addition to the capillary action, that arrangement then also provides the suction effect of the suction piston formed from the applicator stem together with the tubular mixing insert. Accordingly conveyance of the application substance upwardly in the tubular mixing insert is enhanced, whereby the effectiveness of the mixing principle is further improved.

In an advantageous development of the fifth aspect of the invention the mixing insert is additionally in the form of a plurality of tube elements which are disposed one within the other, wherein mutually adjacent tube elements respectively form an annular gap. The longitudinal axes of the tube elements are in that case arranged substantially parallel to the longitudinal axis of the container. In that way the application substance is stored in the container substantially in a plurality of capillary gaps, whereby separation of the mixture ingredients of the application substance can be substantially prevented from the outset.

It should also be noted that basically in all aspects of the invention it is possible for the mixing insert or the mixing insert at the container opening to be designed to be connectable to the closure in such a way that a rotary movement of the closure in the closed condition of the container about the longitudinal axis of the container is converted into a corresponding rotary movement of the mixing insert at least in one direction of rotation. A corresponding entrainment mechanism can be embodied for example with a rotary closure which is constructed similarly to a child-proof closure. To open the container the closure then has to be pressed for example in the direction of the cosmetic container so that rotation of the rotary closure is possible. Otherwise the rotary movement at the closure is only transmitted to the mixing insert which in engagement with the closure.

A releasable connection between the mixing insert and the closure can be designed for example like a ratchet, that is to say a torque can be transmitted in one direction of rotation by virtue of positively locking engagement but not in the opposite direction of rotation. It will be appreciated that it is also possible for a rotary movement of the closure about the longitudinal axis of the container to be converted into a corresponding rotary movement of the mixing insert in both directions of rotation. For that purpose for example a structure on the applicator stem in the region on the closure can co-operate with a correspondingly complementary structure at the opening of the tubular mixing insert so that this affords a positively locking connection which transmits the applied torque from the closure to the mixing insert in either direction of rotation. Thus it is also possible for the positively locking releasable connection between the applicator stem and the mixing insert to be so designed that rotation of the mixing insert is produced only when the applicator stem is partially withdrawn from or inserted into the container. In other words, prior to application, the closure is opened, the applicator stem on the closure is withdrawn by a portion until the connection is made, and then the desired mixing operation is carried out by some rotational movements at the closure.

It should be noted that, in all aspects of the present invention, it is also advantageous to provide at the mixing insert in the proximity of the container opening a scraper which bears against the applicator stem when the applicator stem is introduced into or withdrawn the container through the opening thereof. In that respect the scraper is preferably adapted to prevent excess application substance or application substance disposed on the applicator stem from issuing through the container opening when the applicator is introduced or withdrawn.

It is further to be noted that it is readily apparent to the man skilled in the art that individual features of the individual aspects can also be transferred to or combined with the other aspects.

BRIEF DESCRIPTION OF THE DRAWINGS

Further advantages of the invention are described in conjunction with the description of embodiments by way of example of the present invention together with the drawings. The terms "left", "right", "down" and "up" used herein relate to the drawings with the Figure designations normally readable. It is further to be pointed out that the same or similar parts can be identified by the same references in the individual Figures.

In the drawings.

DETAILED DESCRIPTION

Basically it is to be stated in advance here that the embodiments by way of example of the invention which are shown in the individual Figures are in two parts, the left-hand part being a broken-away three-dimensional view and the right-hand part being a perpendicular cross-section from the side of the cosmetic container.

Figure 1A:
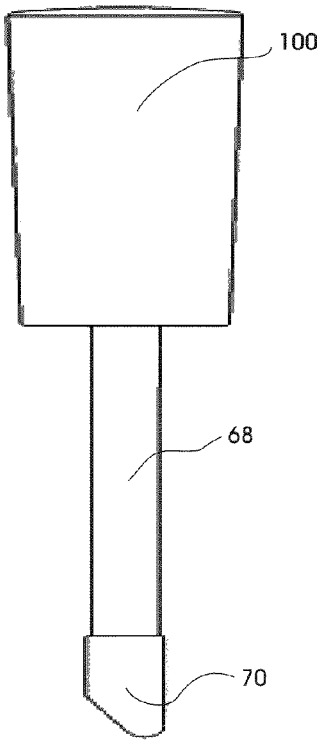
FIG. 1*a* shows a first embodiment of the cosmetic container according to the first aspect of the invention.
Figure 1A:
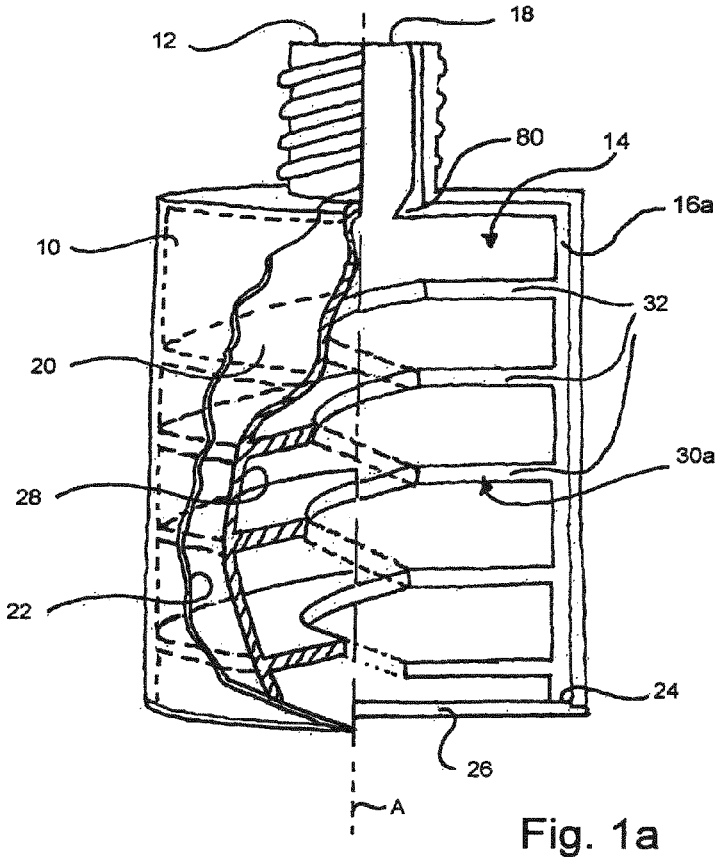

FIG. 1*a* shows a cosmetic container in accordance with a first embodiment of the first aspect of the present invention. The cosmetic container comprises a container body 10 with a container opening 12 at which there is provided a removable closure 100 having an applicator stem 68 (see for example FIG. 6 or FIG. 7) at which there is an applicator 70 (see for example FIG. 6 or FIG. 7).

Also in the interior of the container body 10 there is a hollow space 14 for receiving the applicator stem, the applicator and the application substance. Disposed in the space 14 is the radial mixing insert 16*a* which is stationary with respect to the container body 10 and which is rotatable about the longitudinal axis A of the container and which has a first end 18 that is fitted into the container opening 12 and that is coincident with the container opening 12 and can be releasably connected there to the closure (not shown) and/or the applicator stem. For that purpose the closure and/or the applicator stem in the closed condition of the container can cooperate for example in positively locking relationship with the radial mixing insert in such a way that a rotary movement at the closure when opening or closing the container about the longitudinal axis A of the container is converted into a corresponding rotary movement of the radial mixing insert 16*a* in at least one of the two possible directions of rotation.

The radial mixing insert 16*a* and the space 14 are of a rotationally symmetrical configuration with respect to the longitudinal axis A of the container. The entire outside surface 20 of the radial mixing insert 16*a,* which is towards the inside wall. 22 of the container, bears against the inside wall 22 of the container. It will further be seen that, at its second open end 24 in opposite relationship to the container opening 12, the radial mixing insert 16*a* is closed by the container bottom which is formed from a bottom portion 26. As already mentioned hereinbefore, that construction provides that the radial mixing insert 16*a,* in manufacture of the cosmetic container, can be inserted into the container body 10 from the bottom end. The container body 10 is then sealingly closed by insertion of the bottom portion 26, for example by screwing it in or welding it in or the like.

The at least one mixing element 30*a* is provided on the radial mixing insert inside surface 28. In the embodiment illustrated in FIG. 1*a* the mixing element 30*a* is an arm 32*a* extending helically along the inside surface 28 of the radial mixing insert and which forms a conveyor screw. That helical arm 32*a* or the conveyor screw, upon actuation of the radial mixing insert 16*a,* that is to say upon rotation of the radial mixing insert 16*a,* causes thorough mixing of the application substance contained in the space 14.

In order to prevent application substance from issuing through the container opening 12 when the applicator is withdrawn or introduced, provided on the radial mixing insert 16*a* in the proximity of the container opening 12 is a scraper 80 which, when the applicator stem 68 (see in that respect for example FIG. 6) is introduced or withdrawn through the container opening 12, bears against the applicator stem 68 around the entire applicator stem and thus removes or scrapes off excess application substance from the applicator stem.

Figure 1B:
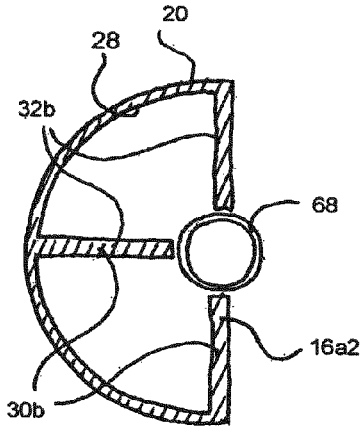
FIG. 1*b* shows a cross-sectional view from above of an alternative configuration of the radial mixing insert for the cosmetic container of FIG. 1*a,*

FIG. 1*b* shows a cross-section of a radial mixing insert 16*a*2, of an alternative configuration, for the cosmetic container of the FIG. 1*a.* FIG. 1*b* shows a plan view from above onto the cross-section of the radial mixing insert 16*a*2 and the applicator stem 68 guided centrally therein, also in cross-section. Provided on the inside surface 28 of the radial mixing insert 16*a* 2 as mixing elements 30*b* are arms 32*b* which extend from below upwardly relative to the container in a straight line and substantially parallel to the longitudinal axis of the container. In other words, in FIG. 1*b* there are a total of three mixing elements 30*b,* namely the three arms 32*b.* Upon actuation, that is to say when the radial mixing insert 16*a*2 is rotated, those arms 32*b* produce thorough mixing of the application substance contained in the space 14 insofar as the arms 32*b* in effect subdivide the space 14 into a large mixing chamber (180° segment) and two small mixing chambers (90° segments), which rotate about the longitudinal axis A of the container, wherein the mixing effect is further increased by the arms 32*b,* at a small spacing relative to the applicator stem 68, having a spatula-like action in that region. Preferably this configuration of the radial mixing insert 16*a*2 is in the form of a half-shell portion. It will be appreciated that it is also possible for the radial mixing insert to be in the form of a smaller or larger segment, in comparison with the illustrated half-shell portion.

Figure 2:
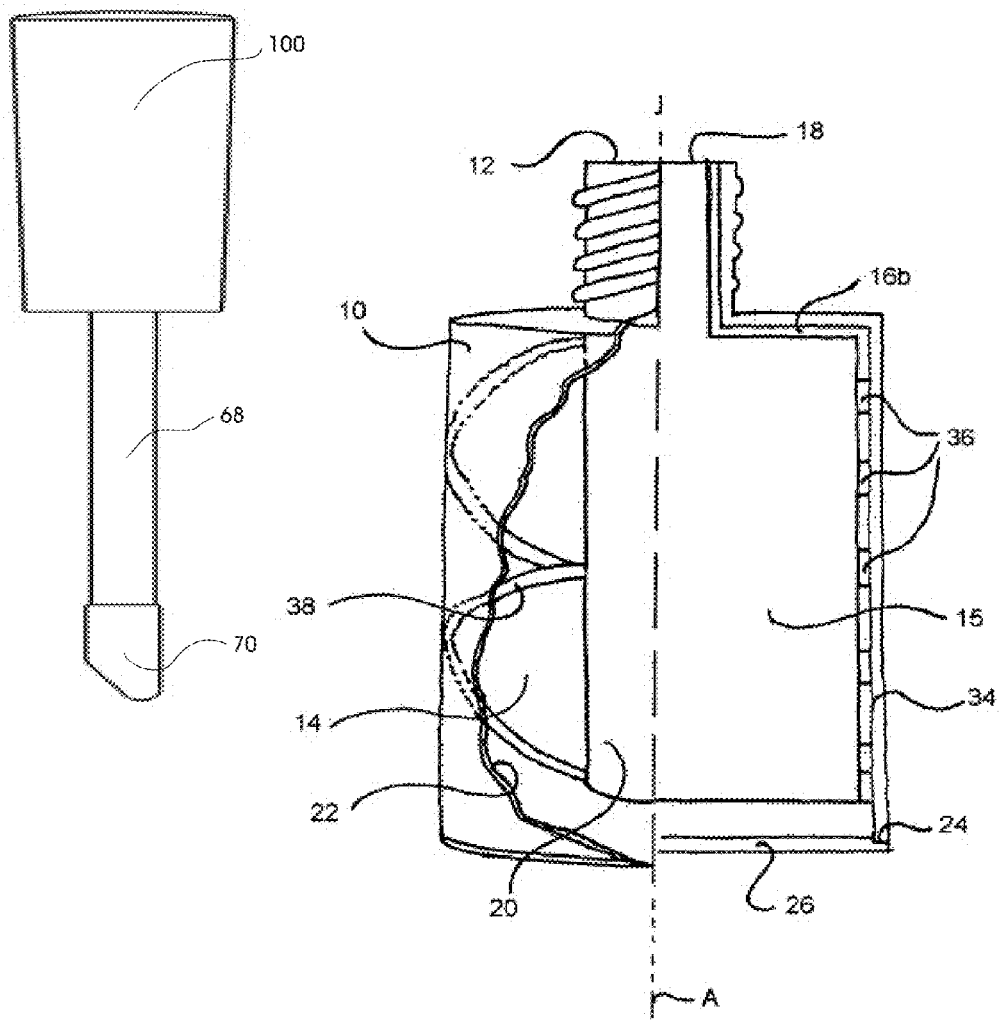
FIG. 2 shows a second embodiment of the cosmetic container according to the first aspect of the invention.

FIG. 2 shows a cosmetic container according to a second embodiment of the first aspect of the present invention. As in FIG. 1*a* the cosmetic container in FIG. 2 comprises a container body 10 with a container opening 12 and the space 14 for receiving a radial mixing insert 16*b* and the application substance. The radial mixing insert 16*b* is arranged in the space 14 stationarily with respect to the container body 10 and rotatably about the longitudinal axis A of the container and once again has a first open end 18 which is fitted into the container opening 12 and which is coincident with the container opening 12 and at which the radial mixing insert 16*b* can be releasably connected to the closure (not shown) and/or the applicator stem 68 (not shown, see for example FIG. 6 or FIG. 7).

In comparison with the space 14 in the container body 10, which is of a rotationally symmetrical configuration with respect to the longitudinal axis A of the container, the radial mixing insert 16*b* is of an oval, that is to say asymmetrical cross-section, and has a mixing edge 34 which bears against the inside wall 22 of the container in substantially parallel relationship with the longitudinal axis A of the container. In addition the radial mixing insert 16*b* has a plurality of mixing apertures 36 in the region of the mixing edge 34. Furthermore a mixing helix 38 with a helix axis in substantially parallel relationship with the longitudinal axis A of the container is arranged on the radial mixing insert 16*b*, opposite the mixing edge 34. The mixing helix 38 is moved through the application substance upon rotation of the radial mixing insert 16*b*. By virtue of the oval shape of the radial mixing insert 16*b* the application substance is forced into or compressed in the inner edge region between the radial mixing insert 16*b* and the inside wall 22 of the container and conveyed through the mixing apertures 36 provided into the interior of the radial mixing insert 15.

Figure 3:
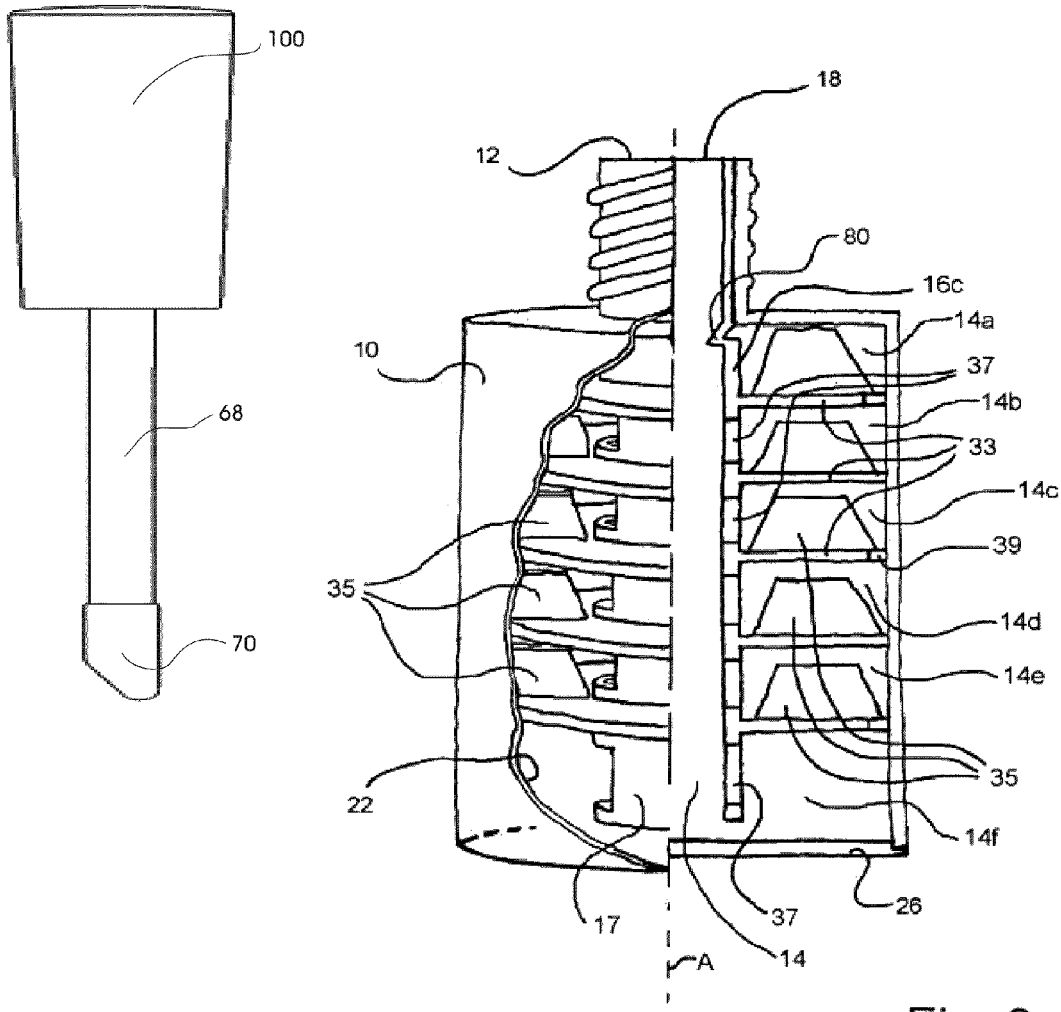
FIG. 3 shows a third embodiment of the cosmetic container according to the first aspect of the invention.

FIG. 3 shows a cosmetic container in accordance with a third embodiment of the first aspect of the invention. It is possible once again to see here the container body 10 with a container opening 12 and the hollow space 14 therein, in which the radial mixing insert 16*c* is fitted, being stationary with respect to the cosmetic container and rotatable about the longitudinal axis A of the container. The radial mixing insert 16*c* has a first open end 18 which is fitted into the container opening 12 and which is coincident with the container opening 12 and which can be releasably connected there to the closure (not shown) and/or applicator stem. As its main body, the radial mixing insert 16*c* has a central tube 17 from which a plurality of mixing element carrier surfaces 33 extend in substantially perpendicular relationship in the direction of the inside wall of the container. That arrangement provides that the space 14 is sub-divided into a plurality of substantially equal-sized mixing chambers 14*a*, 14*b*, 14*c*, 14*d*, 14*e* and 14*f*. Also provided in the central tube 17 in relation to each mixing chamber 14*a*, 14*b*, 14*c*, 14*d*, 14*e* and 14*f* is at least one mixing aperture 37 and in each mixing element carrier surface 33 at least one mixing aperture 39. The mixing apertures 39 in the mixing element carrier surfaces 33 are disposed in adjacent relationship with the inside wall 22 of the container and are preferably arranged in mutually displaced relationship in adjacent mixing element carrier surfaces 33. To increase the mixing effect, in the illustrated embodiment of FIG. 3, mixing elements 35 which are here in the form of mixing vanes are additionally provided in each mixing chamber 14*a*, 14*b*, 14*c*, 14*d*, 14*e* and 14*f* at each mixing element carrier surface 33. It will be appreciated that it is also possible to envisage mixing elements of a different geometrical configuration.

The embodiment of the cosmetic container according to the invention as shown in FIG. 3 also provides a scraper 80 on the radial mixing insert 16*c* in the proximity of the container opening 12 in order to prevent excess application substance from escaping through the container opening 12 when the applicator is withdrawn or inserted, or being disposed on the applicator stem.

Figure 4:
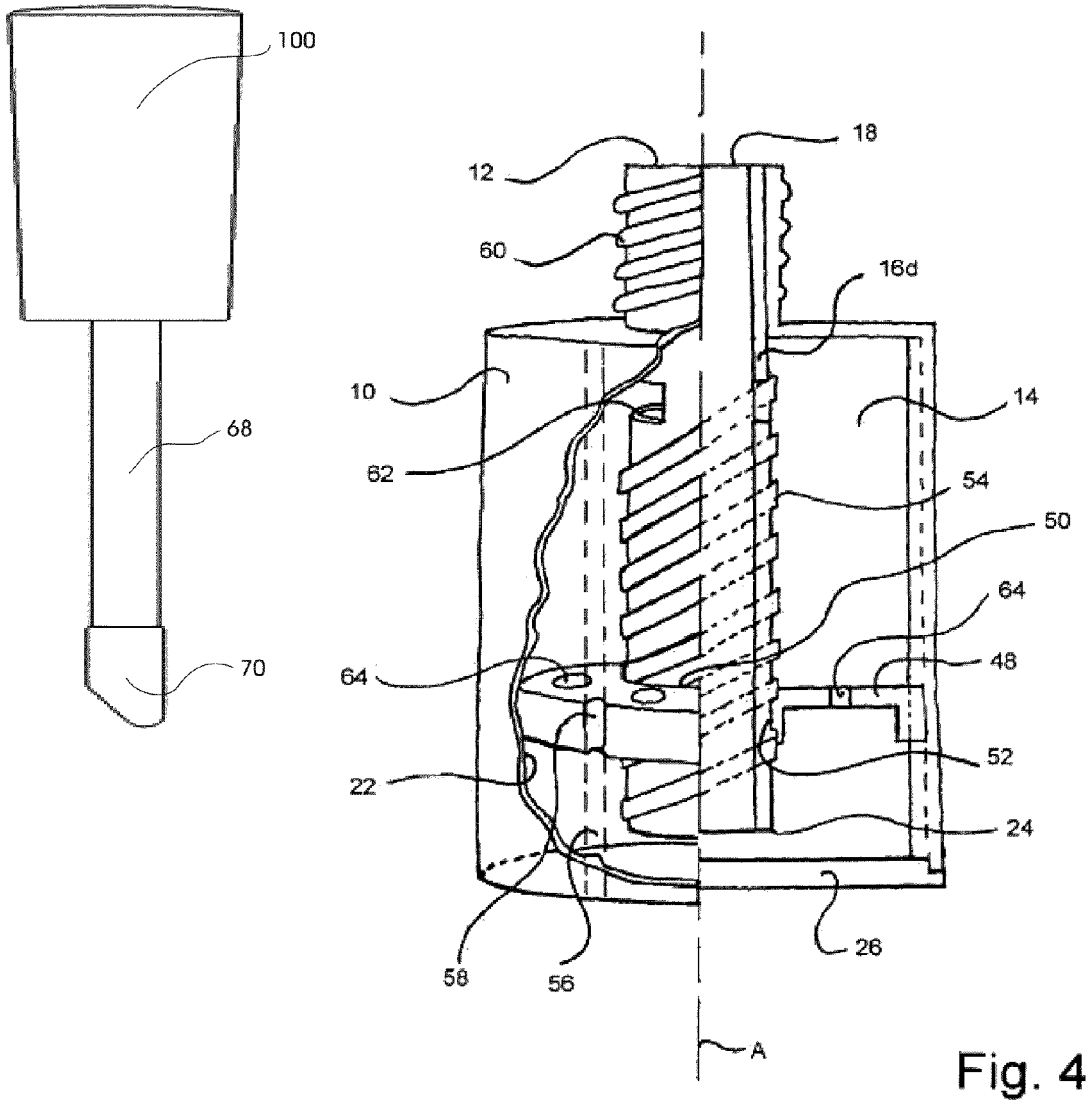
FIG. 4 shows an embodiment of the cosmetic container according to the second aspect of the invention.

FIG. 4 shows a cosmetic container according to an embodiment of the second aspect of the present invention. Shown here is the container body 10 with the container opening 12 and the longitudinal axis A of the container. In this case also FIG. 4 does not show the removable closure on which the applicator with its applicator stem and the applicator element is provided. A tubular mixing insert 16*d* is disposed in the hollow space in the container body 10 for receiving the applicator and the application substance, the mixing insert 16*d* being stationary with respect to the container body 10 and rotatable about the longitudinal axis A of the container.

The mixing insert 16*d* has a first open end 18 which is fitted into the container opening 12 and which is coincident with the container opening 12 and, when the cosmetic container is closed, accommodates the applicator stem (not shown) with the applicator element fixed thereto. As already mentioned hereinbefore, in this embodiment also the mixing insert 16*d* can be releasably connected to the closure (not shown) and/or the applicator stem in such a way that a rotary movement of the closure about the longitudinal axis A of the container can produce a corresponding rotary movement of the mixing insert 16*d*. In addition, a mixing plate 48 is arranged in the region between the mixing insert 16*d* and the inside wall 22 of the container.

The mixing plate 48 has a central hole 50 with a female screwthread 52 which is in engagement with a male screwthread on the mixing insert 16*d*. In addition, a guide means can be provided between the inside wall 22 of the container and the mixing plate 48 as a rotation-preventing means, more specifically on the inside wall 22 of the container, a leg 56 which extends upwardly from the container bottom 26 and which is in engagement with a corresponding recess or groove 58 provided in the edge of the mixing plate 48. That prevents rotation of the mixing plate 48 about the longitudinal axis A of the container and converts a rotary movement of the mixing insert 16*d* into a stroke movement of the mixing plate 48 along the longitudinal axis A of the container, by way of the screwthread guide configuration. It should be noted in this connection that it has been found that, with suitable dimensioning of the mixing plate 48 and the container and a suitable choice of material, sufficient friction occurs between the mixing plate 48 and the inside wall 22 of the container to prevent unwanted entrainment of the mixing plate 48 in the direction of rotation. In other words, under those preconditions, it is also possible to dispense with the illustrated guide means.

The closure for the container body 10 at the container opening 12 is in the form of a screw closure, as can be seen from the screwthread 60 in the region of the container opening 12. It is particularly advantageous for the pitch of the male screwthread 54 of the mixing insert 16*d* to be so matched to the pitch of the screwthread 60 of the screw closure that the required rotary movements of the closure when opening or closing the container are converted into the desired stroke movement of the mixing plate 48.

In addition the rotatable tubular mixing insert 16*d* has at least one mixing aperture 62 in its region towards the neck of the container body 10. Furthermore a plurality of mixing apertures 64 are provided in the mixing plate 48.

Actuation of the mixing apparatus takes place by opening or closing the cosmetic container. As already described hereinbefore a rotary movement at the closure when opening or closing same is converted into a corresponding stroke movement of the mixing plate 48 by co-operation of the closure and/or the inserted applicator stem with the mixing insert 16*d*. That causes the application substance to be mixed up or thoroughly mixed in the desired manner, by the application substance being moved by the mixing plate 48 and thus pressed through the mixing apertures 62, 64.

Figure 5:
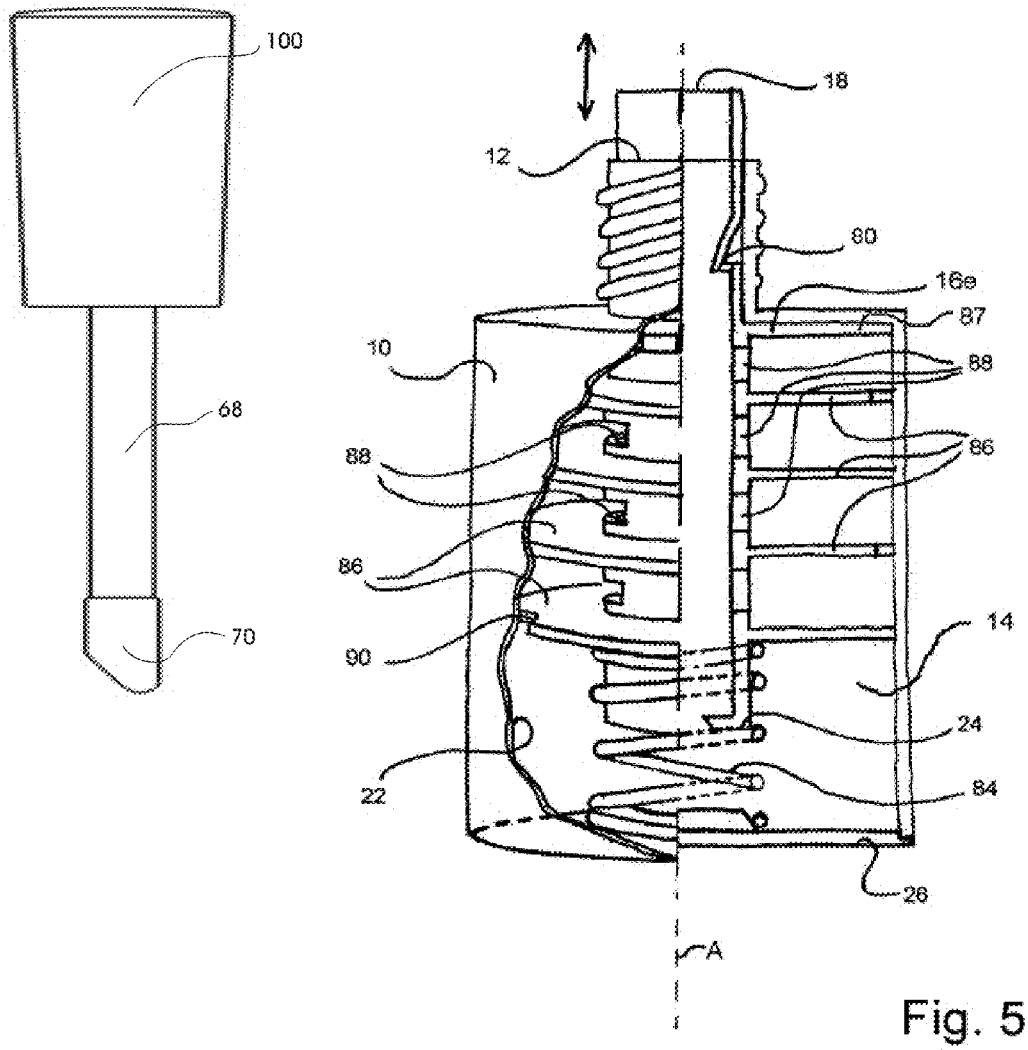
FIG. 5 shows an embodiment of the cosmetic container according to the third aspect of the invention.

FIG. 5 shows a cosmetic container In accordance with an embodiment of the third aspect of the present invention. In comparison with the preceding embodiments of the invention, the cosmetic container comprises in the hollow space 14 therein a tubular mixing insert 16*e* which has a first open end 18 which is fitted into the container opening 12 and which is coincident with the container opening 12 and which is so adapted that the mixing insert 16*e* is reversibly displaceable in the direction of the longitudinal axis A of the container over a limited distance.

For that purpose the mixing insert 16*e* is supported resiliently by means of a spring means arranged between the mixing insert 16*e* and the container bottom 26. The spring means in FIG. 5 is a compression spring 84. As shown in FIG. 5, when the cosmetic container is opened the mixing insert 16*e* is urged upwardly in the direction of the container opening 12 by the compression spring 84, that is to say it is displaced by a limited distance.

Arranged on the tubular mixing insert 16*e* are mixing plates 86 which are perpendicular relative to the longitudinal axis A of the container and which extend from the mixing insert 16*e* in the direction of the inside wall 22 of the container and which are spaced from each other. In that case the mixing stroke movement of the arrangement is established by the uppermost mixing plate 87, more precisely the mixing stroke movement involves the spacing of the uppermost mixing plate 87 when the container is closed relative to the upper inside wall 22 of the container, in which the container opening 12 is disposed.

Over the entire region which is in the hollow space 14 in the container, the tubular mixing insert 16*e* has at least one mixing aperture 88 between two respective adjacent mixing plates 86. In addition in the proximity of the inside wall 22 of the container the mixing plates 86 have mixing apertures 90 which are arranged in mutually displaced relationship on two respective mutually adjacent mixing plates 86. As a result the entire mixing insert 16*e* for the application substance forms a labyrinth-like arrangement through which the application substance is urged upon actuation of the mixing insert, that is to say when the mixing insert is displaced by the limited distance upon opening of the container or closure of the container.

It should also be noted in relation to FIG. 5 that it is also possible, in place of the mixing plates 86, to use a single mixing surface (not shown) which extends in a helical configuration around the tubular mixing insert 16*f* and which is guided in the region between the mixing insert 16*f* and the inside wall 22 of the container.

In order to prevent application substance from issuing through the container opening 12 when the applicator 66 is withdrawn or introduced, in this case also a scraper 80 is provided on the mixing insert 16*e* in the proximity of the container opening 12. When the applicator stem 68 is introduced or withdrawn through the container opening 12, the scraper 80 bears against the applicator stem 68 around the entire applicator stem 68 and serves to retain excess application substance when the applicator 66 is withdrawn from the container.

Figure 6:
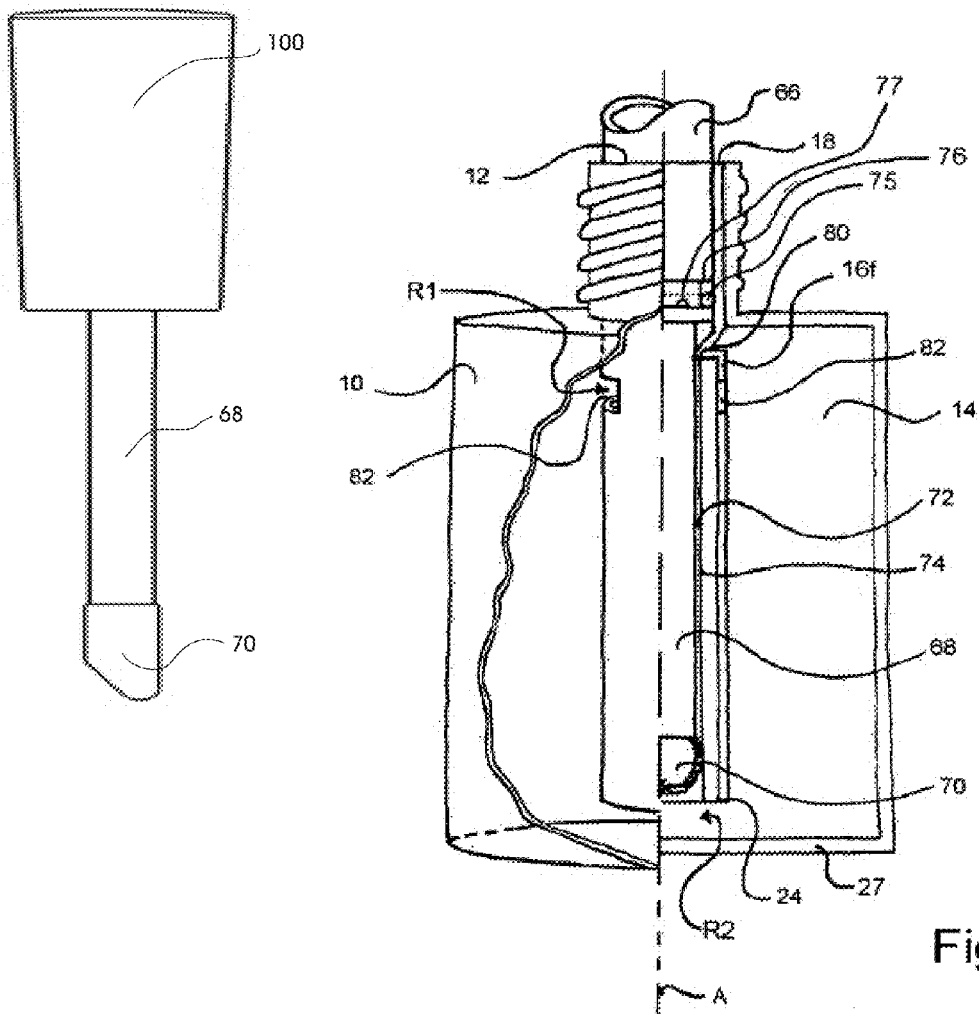
FIG. 6 shows an embodiment of the cosmetic container according to the fourth aspect of the invention.

FIG. 6 shows a cosmetic container in accordance with an embodiment in accordance with the fourth aspect of the present invention. The mixing insert 16*f* and the applicator stem 68 are of such dimensions in a region adjacent to the closure, that is to say at the container opening 12, that the outside diameter of the applicator stem 68 corresponds there to the inside diameter of the mixing insert 16*f*. In FIG. 6, in that region, the applicator stem 68 of FIG. 6 has a piston extension 66. As a result the applicator stem 68, that is to say the piston extension 66, together with the mixing insert 16*f* in that region forms a suction piston by means of which a suction effect is produced when the applicator stem 68 is withdrawn from the cosmetic container. That suction effect causes application substance to be conveyed through the lower open end 24 of the mixing insert 16*f* and then conveyed upwardly in the mixing insert 16*f*. An O-ring seal 75 can further be provided on the piston extension 66 in order to enhance that suction piston function.

A mixing aperture 82 is provided on the mixing insert 16*f* in the immediate proximity of the container opening or the neck of the container opening. It has been found to be particularly advantageous for the open area R1 of that mixing aperture 82 to be substantially larger than the open area of the gap R2 formed by the lower end 24 of the tubular radial mixing insert 16*f* together with the container bottom 27.

In addition provided in the piston extension 66 of the applicator stem 68 is a valve comprising a valve groove 76 in the piston extension 66 and a vent opening 77. The valve has two operational states, namely vent opening 77 open and vent opening 77 closed. Those two functional states are determined by the position of the vent opening 77 and the position of the O-ring seal 75 in the valve groove 76. For that purpose the O-ring seal 75 is supported displaceably in the valve groove and the position of the O-ring seal 75 is controlled by the currently prevailing or last direction of movement of the applicator stem 68 in the direction of the longitudinal axis A of the container. The valve is so designed that, when the container is opened, the vent opening 77 is closed. That provides that the above-described suction action can be built up in the tubular mixing insert 16*f*. When the container is closed the annular seal 75 is displaced in the valve groove 76 in such a way that the vent opening 77 is cleared, that is to say it is open. The vent opening 77 is in communication with the ambient atmosphere of the container, more precisely the ambient pressure, by way of a passage (not shown in greater detail in FIG. 6) in the piston extension 66 or the closure fixed thereto.

The valve prevents an increased pressure being built up in the container in relation to the ambient atmosphere upon closure of the container by virtue of co-operation of the applicator stem 68 with the mixing insert 16*f*. This therefore ensures that, neither upon closure of the container nor upon subsequent storage of the closed container, application substance can unintentionally escape due to an internal pressure which is increased in relation to the ambient atmosphere.

In order to prevent application substance from escaping through the container opening 12 when the applicator stem 68 with the applicator 70 is withdrawn or introduced, this embodiment also provides a scraper 80 on the mixing insert 16*f* in the proximity of the container opening 12. When the applicator stem 68 is introduced or withdrawn through the container opening 12, the scraper 80 bears against the applicator stem 68 around the entire applicator stem 68 and serves to retain excess application substance when the applicator 70 is withdrawn from the container.

Figure 7A:
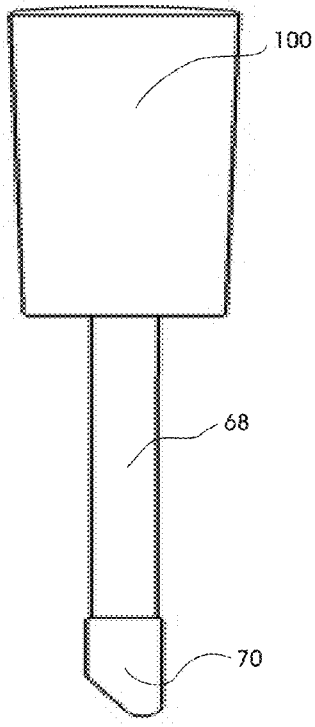
FIG. 7*a* shows an embodiment of the cosmetic container according to the fifth aspect of the invention.

FIG. 7*a* shows a cosmetic container in accordance with a first embodiment of the fifth aspect of the present invention. The container body 10 once again has a container opening 12 which, as in above-described FIGS. 1*a* to 6, can be closed with a removable closure (not shown) to which an applicator stem 68 with applicator 70 is fixed. The hollow space 14 in the container body 10 serves to receive the applicator stem 68, the applicator 70, the application substance and a tubular mixing insert 16*g* which once again has a first open end 18 coincident with the container opening 12 and which here is of such a configuration that a capillary gap 72 exists between the applicator stem 68 and the mixing insert 16*g* when the cosmetic container is closed, in the region of the space 14.

To increase the effective area of the capillary gap 72 the tubular radial mixing insert 16*g*, on the inside 74 which faces towards the inserted applicator stem 68, has arms 76 which extend in parallel relationship with the longitudinal axis A of the container and which are arranged similarly to annularly inwardly directed lamellar plate portions, wherein a respective capillary chamber 73 is formed by each two respective adjudicator arms 76. That provides for an increase in the size of the operative area of the capillary gap 72 between the end faces of the arms 76 and the applicator stem 68. The capillary action of the capillary gap 72 provides that the applicator substance is drawn up into the radial mixing insert 16*g* when the applicator stem 68 is withdrawn when the cosmetic container is opened, thereby on the one hand preventing the mixture of the application substance from separating out into its individual components while in addition causing the application substance to be mixed up or thoroughly mixed.

It should also be noted that, to enhance the transport of application substance in the radial mixing insert 16*g*, the applicator stem 68, in a region adjacent to the closure, that is to say at the container opening 12, can be designed in accordance with the above-described fourth aspect of the invention. In other words, the applicator stem 68 in FIG. 7*a* has an applicator shoulder 67 which is of an outside diameter which corresponds to the inside diameter of the radial mixing insert 16*g* at least in the region of the neck at the container opening 18. To improve the suction effect which is desired therewith, it would also be possible here to provide an O-ring seal while to avoid an increased internal pressure it would be possible to provide the valve described with reference to FIG. 6.

The application substance which is conveyed upwardly in the radial mixing insert 16*g* when the applicator stem is withdrawn due to the capillary action or the suction piston action can flow back into the space 14 in the container body 10 from the inside region of the radial mixing insert 16*g* in the proximity of the closure through one or more mixing apertures 82 provided in the radial mixing insert 16*g*. It has proven to be advantageous in that respect for a multiplicity of such mixing apertures 82 to be provided over the entire region of the radial mixing insert 16*g*, which is disposed in the space 14.

Figure 7A:
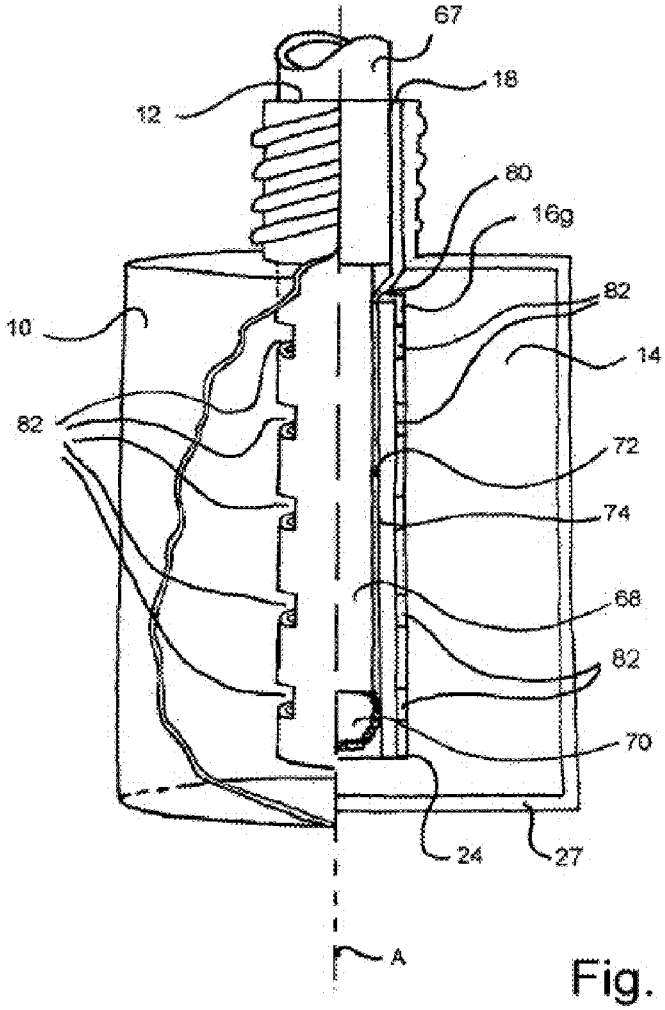
Figure 7B:
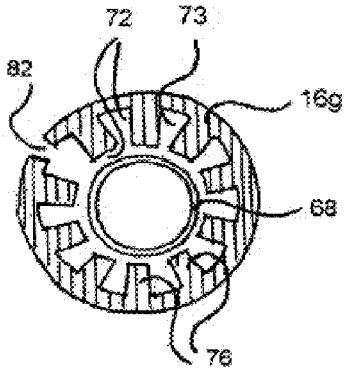
FIG. 7*b* shows a cross-sectional view of the radial mixing insert of the cosmetic container of FIG. 7*a,* and FIG. 8 shows an advantageous development of the cosmetic container according to the fifth aspect of the invention.

FIG. 7*b* shows a view in cross-section illustrating a portion of the radial mixing insert 16*g* together with the applicator stem 68 in order clearly to show the increase in size in the effective capillary gap 72 achieved by virtue of the arrangement of the arms 76. It should be noted that FIG. 7*b* is a diagrammatic view only intended to illustrate the principle involve, that is to say in actual fact there are markedly more arms 72 in order to dimension the capillary chambers 73 formed, in such a way that the desired capillary action occurs.

In order to prevent application substance escaping through the container opening 12 when the applicator 70 which is fixed to the applicator stem 68 is withdrawn or introduced, in this case also the radial mixing insert 16*g*, in the proximity of the container opening 12, has a scraper 80 which, upon introduction or withdrawal of the applicator stem 68 through the container opening 12, bears against the applicator stem 68 around the entire periphery thereof.

Figure 8:
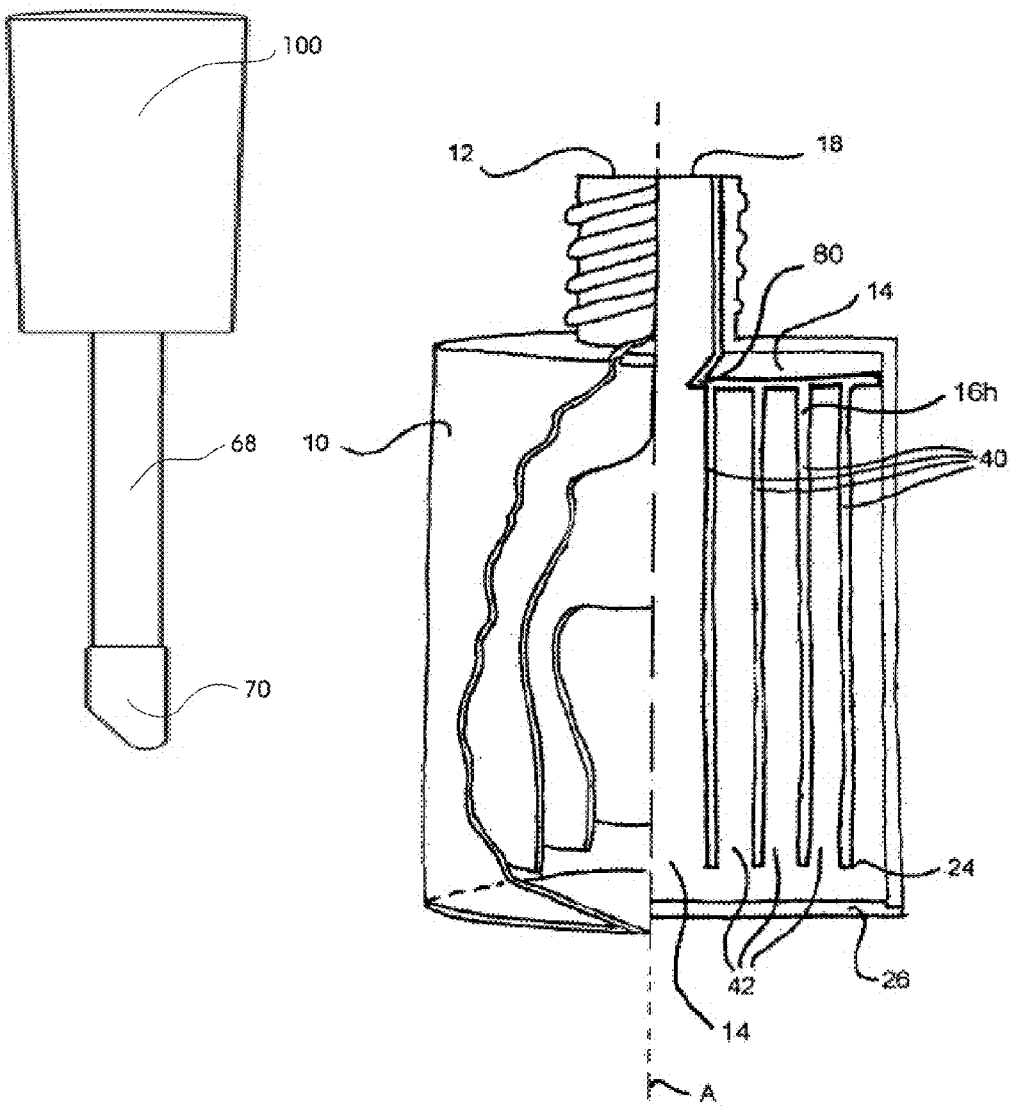

FIG. 8 shows an advantageous development of the cosmetic container shown in FIGS. 6 and 7. In this case the mixing insert 16*h* has the first open end 18 which is fitted into the container opening 12 and which is coincident with the container opening 12. In comparison with FIGS. 6 and 7, the mixing insert 16*h* is in the form of a plurality of tube elements 40 or cylinders which are fitted one within the other, wherein mutually adjacent tube elements 40 form a respective annular gap 42 which once again is of such a dimension that it acts as a capillary gap for the application substance. The longitudinal axes of the tube elements are arranged in substantially parallel relationship with the longitudinal axis A of the container. In that way the application substance can be stored in the container substantially in the multiplicity of capillary gaps, whereby it is possible to prevent the mixture of the application substance from separating out into its individual ingredients substantially from the outset. With progressive emptying of the cosmetic container, the application substance sinks downwardly out of the capillary gaps and can be taken off by way of the applicator.

The cosmetic container shown in FIG. 8 also provides a scraper 80 on the mixing insert 16*h* in the proximity of the container opening 12 in order to prevent application substance from escaping through the container opening 12 upon withdrawal or introduction of the applicator.

The above-described embodiments by way of example of the various aspects of the present invention disclose various structures for a cosmetic container with integrated mixing insert, wherein the mixing inserts serve to mix up or thoroughly mix an application substance contained in the cosmetic container and/or to prevent or delay separation of the application substance contained therein into its phases. In that respect the mixing inserts according to the invention are preferably so designed that an application substance is mixed up in the cosmetic container shortly prior to application thereof by a respective mixing operation in accordance with the invention in order to guarantee homogeneity of the application substance.

Finally it should be noted that the use of the container according to the invention is not limited to cosmetic products. In principle the container can be used in all sectors in which substances to be applied are to be applied to a surface with an applicator element and sufficiently accurately metered loading of the applicator element with a sufficiently homogenous, that is to say thoroughly well mixed, application substance, is to be guaranteed.

The invention claimed is:

1. A cosmetic container comprising a container body (10) having a longitudinal axis (A), a top wall, a bottom wall and a cylindrical side wall connecting the top wall and bottom wall, a container opening (12) in the top wall with a removable closure, on which there is provided an applicator stem having an applicator arranged at an end in opposite relationship to the closure, and a hollow space (14) defined by the top wall, bottom wall and side wall for receiving the applicator stem, the applicator and an application substance, wherein provided in the hollow space (14) is a radial mixing insert (16*a*; 16*a*2; 16*b*; 16*c*) having a top surface and a bottom surface which abut the top wall and bottom wall of the container body, respectively, and an elongated arcuate side wall (20) contacting the top surface and bottom surface wherein the radial mixing insert is axially stationary with respect to the container body (10) along the longitudinal axis (A) and which is rotatable about the longitudinal axis (A) and which has an open end (18) fitted into the container opening (12) and coincident with the container opening (12) and which can be releasably connected to at least one of the closure and the applicator stem, and wherein the hollow space (14) is of a rotationally symmetrical configuration with respect to the longitudinal axis (A) of the container and the arcuate elongated side wall (20) of the radial mixing insert (16*a*; 16*a*2) has a length substantially equal to the length of the cylindrical side wall wherein the entire length bears against an inside surface of the cylindrical side wall (22) of the container.

2. A container according to claim 1 wherein at least one of the closure and the applicator stem in the connected condition co-operate in such a way that a rotary movement of the closure about the longitudinal axis (A) of the container produces a corresponding rotation of the radial mixing insert (16*a*; 16*a*2; 16*b*; 16*c*) in at least one direction of rotation.

3. A container according to claim 1 wherein the radial mixing insert (16*a*2) is in the form of a half-shell portion.

4. A container according to claim 1 wherein at least one mixing element (30*a*; 30*b*) is provided at an inside surface (28) of the radial mixing insert (16*a*; 16*a*2).

5. A container according to claim 4 wherein the at least one mixing element (30*b*) is a straight arm (32*b*) extending along the inside surface of the radial mixing insert (16*a*2).

6. A container according to claim 4 wherein the at least one mixing element (30*a*) is an arm (32*a*) extending helically along the inside surface of the radial mixing insert.

7. A container according to claim 1 wherein the elongated arcuate side wall is semi-circular.

* * * * *